US005637031A

United States Patent [19]

Chen

[11] Patent Number: 5,637,031

[45] Date of Patent: Jun. 10, 1997

[54] ELECTROCHEMICAL SIMULATOR FOR CHEMICAL-MECHANICAL POLISHING (CMP)

[75] Inventor: Lai-Juh Chen, Hsin-Chu, Taiwan

[73] Assignee: Industrial Technology Research Institute, Hsinchu, Taiwan

[21] Appl. No.: 660,307

[22] Filed: Jun. 7, 1996

[51] Int. Cl.[6] ..... B24B 1/00

[52] U.S. Cl. ..... 451/41; 451/285; 451/5

[58] Field of Search ..... 451/5, 8, 9, 285, 451/286, 287, 288, 41; 156/645.1, 636.1; 437/228, 7

[56] References Cited

U.S. PATENT DOCUMENTS

| | | | |
|---|---|---|---|
| 5,032,203 | 7/1991 | Doy et al. | 156/345 |
| 5,132,617 | 7/1992 | Leach et al. | 451/8 |
| 5,320,706 | 6/1994 | Blackwell | 156/636 |
| 5,481,475 | 1/1996 | Young | 364/491 |
| 5,562,529 | 10/1996 | Kishii et al. | 451/36 |
| 5,575,706 | 11/1996 | Tsai et al. | 451/41 |

*Primary Examiner*—James G. Smith
*Assistant Examiner*—Derris H. Banks
*Attorney, Agent, or Firm*—George O. Saile

[57] ABSTRACT

An improved and new apparatus and process for simulating chemical-mechanical polishing (CMP) processes, which allows changes in polish removal rates and removal rate uniformity to be measured online as a function of changes in process parameters without necessity to use monitor wafers and offline thickness measurement tools, has been developed. The result is more efficient and lower cost process development for CMP.

27 Claims, 5 Drawing Sheets

ELECTROCHEMICAL SIMULATOR FOR CHEMICAL-MECHANICAL POLISHING (CMP)

BACKGROUND OF THE INVENTION (1) Field of the Invention

This invention relates to an apparatus and method for chemical/mechanical polishing (CMP) a semiconductor substrate and more particularly to an apparatus and method for simulating CMP conditions in order to efficiently study the behavior of CMP processes while varying process parameters.

(2) Description of Related Art

Chemical-mechanical polishing (CMP) has been developed for providing smooth topographies on surfaces deposited on semiconductor substrates. Rough topography results when metal conductor lines are formed over a substrate containing device circuitry. The metal conductor lines serve to interconnect discrete devices and thus form integrated circuits. The metal conductor lines are further insulated from the next interconnection level by thin layers of insulating material and holes formed through the insulating layers provide electrical access between successive conductive interconnection layers. In such wiring processes, it is desirable that the insulating layers have a smooth topography, since it is difficult to lithographically image and pattern layers applied to rough surfaces. CMP can, also, be used to remove different layers of material from the surface of a semiconductor substrate. For example, following via hole formation in an insulating layer, a metallization layer is deposited and then CMP is used to produce planar metal studs embedded in the insulating layer.

Briefly, the CMP processes involve holding and rotating a thin, flat wafer of the semiconductor material against a wetted polishing surface under controlled chemical, pressure, and temperature conditions. A chemical slurry containing a polishing agent, such as alumina or silica, is used as the abrasive material. Additionally, the chemical slurry contains selected chemicals which etch various surfaces of the wafer during processing. The combination of mechanical and chemical removal of material during polishing results in superior planarization of the polished surface.

Numerous process parameters affect the polishing results. Process parameters include polish slurry composition, polish slurry temperature, polish pad material, rotation speed of the polish pad, rotation speed of the wafer carrier, pressure between the wafer carrier and polish pad, and polish time. Also, the use history of the polish pad and the rate of dispensing the polish slurry can affect the polishing results. In addition, the polishing results are dependent on the material being polished, the initial topography of the substrate, and the distribution of topographic pattern density and feature size. Due to the multiplicity of parameters which affect the polishing result and the possibility of complex interaction between parameters, development of CMP processes is time consuming and costly. Usual practice is to use monitor wafers to measure polishing results. Processing of monitor wafers for each process parameter change is costly and time consuming. Also, since monitor wafers are measured off-line, there is considerable time delay in ascertaining the result of a change in process parameters on the polishing process. The inability to readily predict the impact of process parameter changes on the performance of CMP frustrates process development.

While numerous improved CMP methods have been developed as shown in the following U.S. Patents, these methods result only after expenditure of considerable time and resource. U.S. Pat. No. 5,032,203 entitled "Apparatus For Polishing" granted Jul. 16, 1991 to Toshiroh K. Doy et al describes an improved polishing method and apparatus in which a pad conditioning ring containing metallic elements is employed to improve polishing efficiency. U.S. Pat. No. 5,320,706 entitled "Removing Slurry Residue From Semiconductor Wafer Planarization" granted Jun. 14, 1994 to Robert E. Blackwell describes a method and apparatus for chemical/mechanical polishing (CMP) in which, following the polishing step, residual slurry polish residue is removed by polishing with a mixture of deionized water and a surfactant.

The present invention is directed to a novel method and apparatus for simulating CMP processes.

SUMMARY OF THE INVENTION

One object of the present invention is to provide an improved and new apparatus and method for chemical-mechanical polishing (CMP).

Another object of the present invention is to provide a new and improved apparatus and method for simulating CMP processes in order to efficiently study the behavior of polish removal rates while varying process parameters.

A further object of the present invention is to provide a new and improved apparatus and method for simulating CMP processes which allows changes in polish removal rates and removal rate uniformity to be measured online as a function of changes in process parameters without necessity to use monitor wafers and offline thickness measurement tools.

In an illustrative embodiment, apparatus for carrying out the method of the invention comprises: a rotatable platen and polishing pad for chemical/mechanical polishing (CMP) a surface of a semiconductor wafer; a reservoir for a polishing slurry and means to dispense the slurry onto the polishing pad; a counter-electrode embedded in the rotatable platen; a rotatable carrier holder and carrier having a plurality of electrodes embedded in the surface thereof; a means for holding the rotatable carrier holder and carrier in juxtaposition relative to the rotatable platen and polishing pad with an applied pressure between the carrier and the polishing pad; a means of applying a constant voltage between each electrode embedded in said rotatable carrier and said counter-electrode embedded in said rotatable platen; a means of measuring the current density in each embedded electrode during polishing simulation; a means of storing in a computer memory data for current density versus polishing simulation time for each electrode among the plurality of electrodes embedded in said rotatable carrier; a means of integrating the measured current density with polishing simulation time for each electrode among the plurality of electrodes embedded in said rotatable carrier; and a means of storing in a computer memory factors, generally called "Sherwood Numbers", which are the integrated current density with polishing simulation time for each electrode among the plurality of electrodes embedded in said rotatable carrier. The "Sherwood Numbers" are proportional to the mass transfer rates, thereby simulating the polish removal rates.

BRIEF DESCRIPTION OF THE DRAWINGS

The object and other advantages of this invention are best described in the preferred embodiments with reference to the attached drawings that include.

DESCRIPTION OF THE PREFERRED EMBODIMENTS

The new and improved CMP apparatus and method for simulating CMP processes, which allows changes in polish removal rates and removal rate uniformity to be measured online as a function of changes in process parameters without necessity to use monitor wafers and offline thickness measurement tools, will now be described in detail. The method can be used to predict polish removal rates and removal rate uniformity as a function of polishing parameters, such as polish slurry composition, polish slurry temperature, polish pad material, rotation speed of the polish pad, rotation speed of the wafer carrier, pressure between the wafer carrier and polish pad, polish time, use history of the polish pad, and the rate of dispensing the polish slurry.

Figure 1:
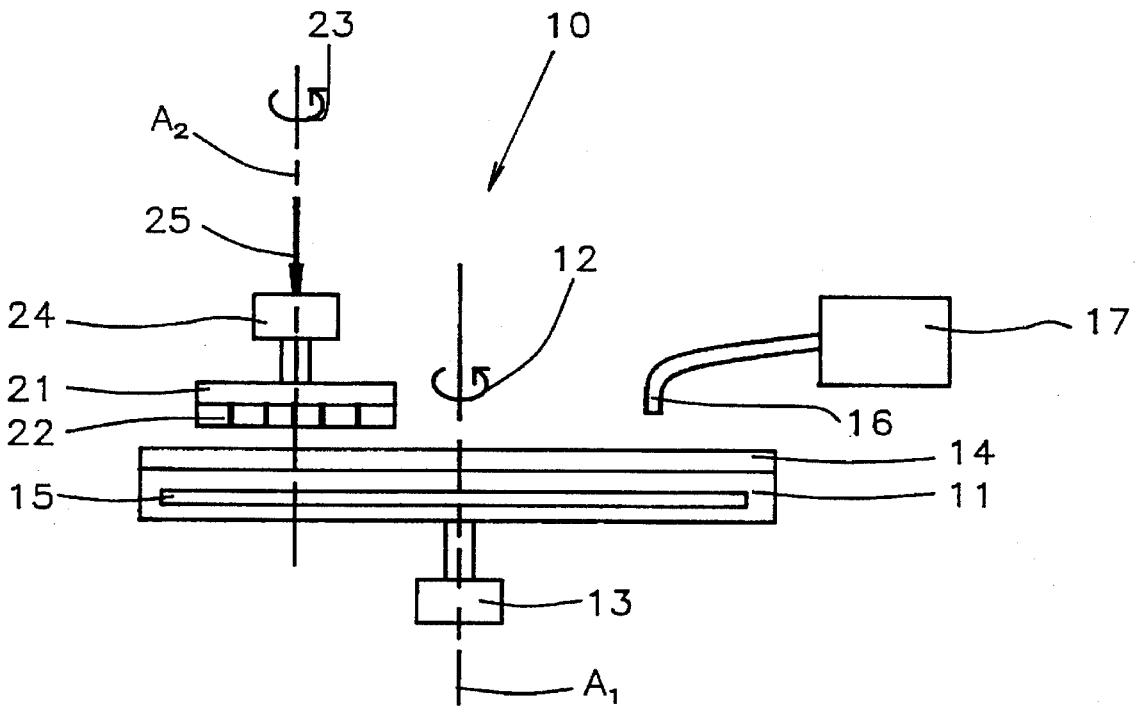
FIG. 1 which schematically, in cross-sectional representation, illustrates a polishing apparatus used in accordance with the method of the invention.
Figure 2A:
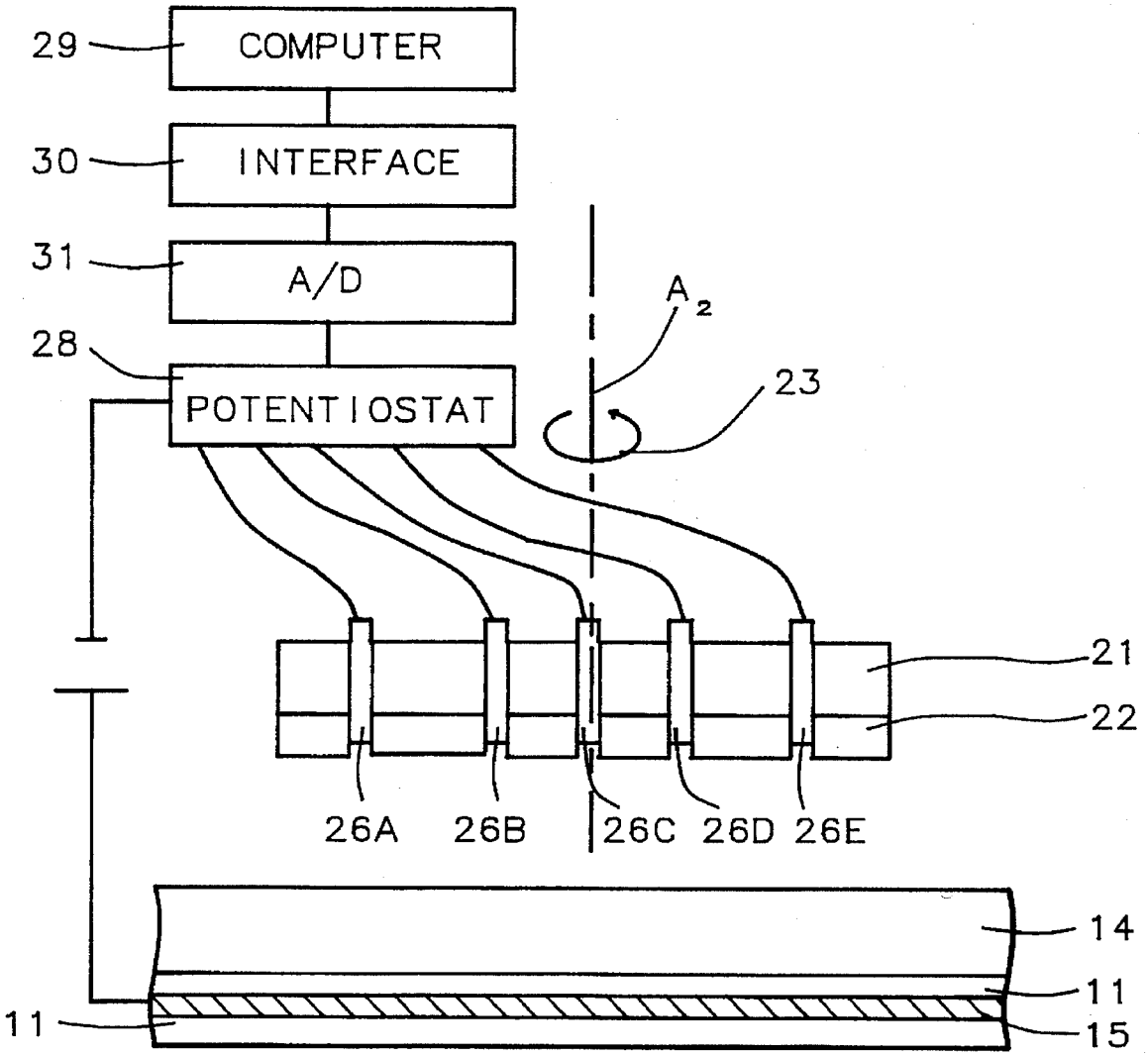
FIG. 2A, which schematically, in cross-sectional representation, illustrates a working electrode, used in accordance with the method of the invention.
Figure 2B:
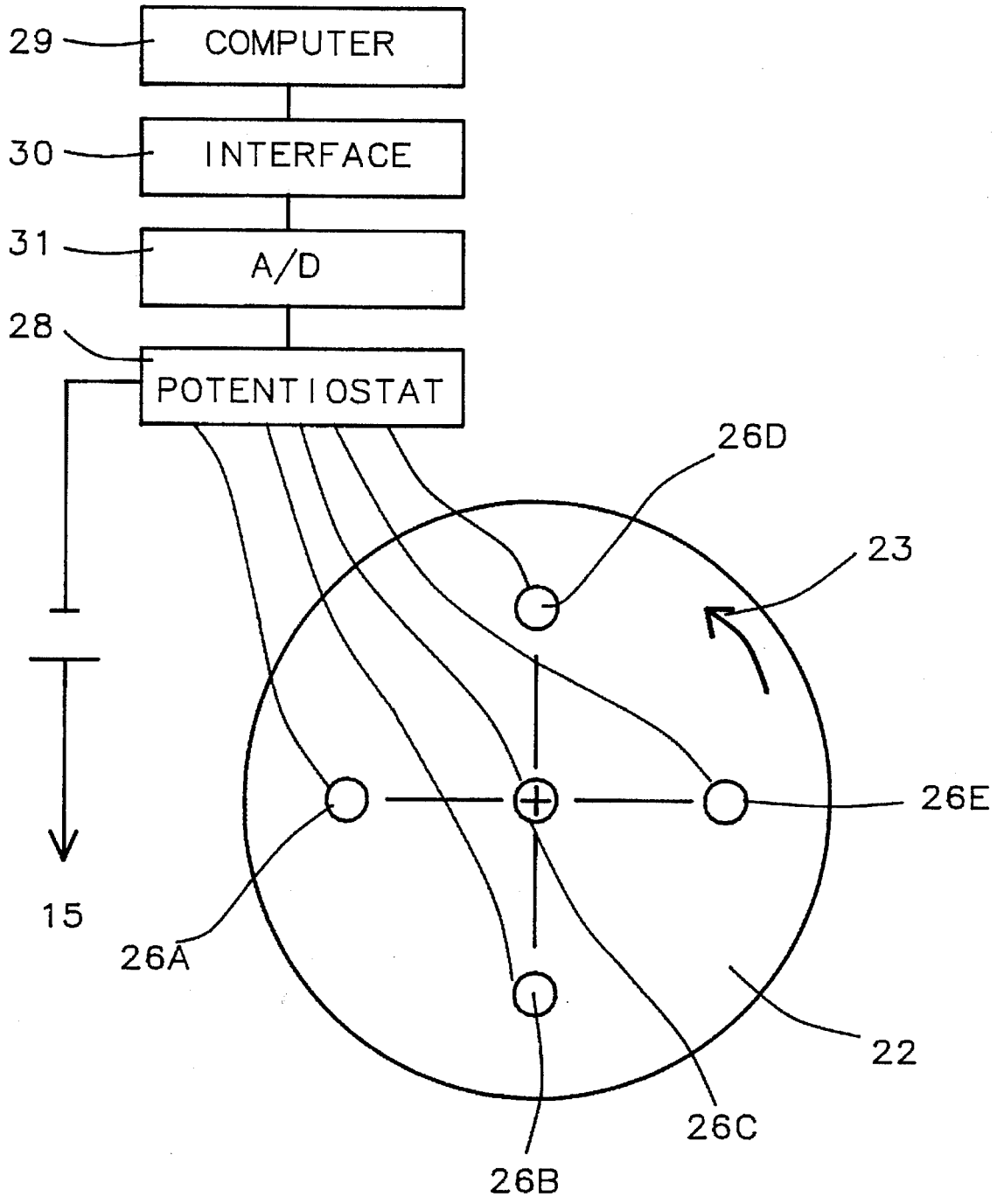
FIG. 2B, which is a top view of the apparatus illustrated in FIG. 2A.

FIG. 1 is a schematic view of a chemical-mechanical polishing (CMP) apparatus for use in accordance with the method of the invention. In FIG. 1, the CMP apparatus, generally designated as 10, is shown schematically in cross-sectional representation. The CMP apparatus, 10, includes a polishing platen, 11, mounted for continuous rotation about axis, A1, in a direction indicated by arrow, 12, by drive motor, 13. A polishing pad, 14, formed of a material such as blown polyurethane or alternate pad material to be studied, is mounted to the polishing platen, 11. Embedded within the polishing platen, 11, is counter-electrode, 15. A polishing slurry containing an abrasive fluid, such as silica or alumina abrasive particles suspended in either a basic or an acidic solution, is dispensed onto the polishing pad, 14, through conduit, 16, from a reservoir, 17. In this invention a critical feature of the apparatus is the working electrode, generally designated as 20. The working electrode, 20, comprises a carrier holder, 21, to which is mounted a carrier, 22. The carrier holder, 21, is adapted for continuous rotation about axis, A2, in a direction indicated by arrow, 23, by drive motor, 24. The carrier holder, 21, is further adapted so that a force indicated by arrow, 25, is exerted between the carrier, 22, and the polishing pad, 14. The carrier, 22, has embedded in its surface a plurality of electrodes, 26A to 26E. In this example, five nickel electrodes are illustrated; however, the number, location and material of the electrodes may be changed to meet the needs of the process. Referring now to FIG. 2A, which is an enlarged cross-sectional view of the carrier, 22, each nickel electrode is attached to a potentiostat, 28, which supplies a constant voltage between about 1 to 5 volts between each electrode and the counter-electrode, 15, embedded within the polishing platen, 11. The potentiostat, 28, also contains a means of measuring the current in each electrode, 26A to 26E. The current density in each electrode, obtained by dividing the current measurement by the cross-sectional area of the electrode, is stored in computer memory, 29, through use of a conventional IEEE/488 interface, 30, and a conventional analog-to-digital (A/D) converter, 31. FIG. 2B is a schematic top view of the carrier, 22, illustrated in FIG. 2A, and shows particularly the spatial distribution of the electrodes, 26A to 26E.

The method of using electrochemical simulation to predict CMP removal rates will now be described in detail. Experimental conditions are set by selecting the polish pad material, polish slurry composition, slurry temperature and rate of dispensing the slurry onto the polishing pad. The rotation speeds of the polishing platen and the carrier are, also, selected and a selected pressure is applied between the carrier and the polishing pad. Typical rotation speeds for the polishing platen, 11, are between about 10 to 100 rpm and for the carrier, 22, are between about 10 to 100 rpm. The pressure between the carrier, 22, and the polishing pad, 14, is between about 1 to 10 psi.

Figure 3:
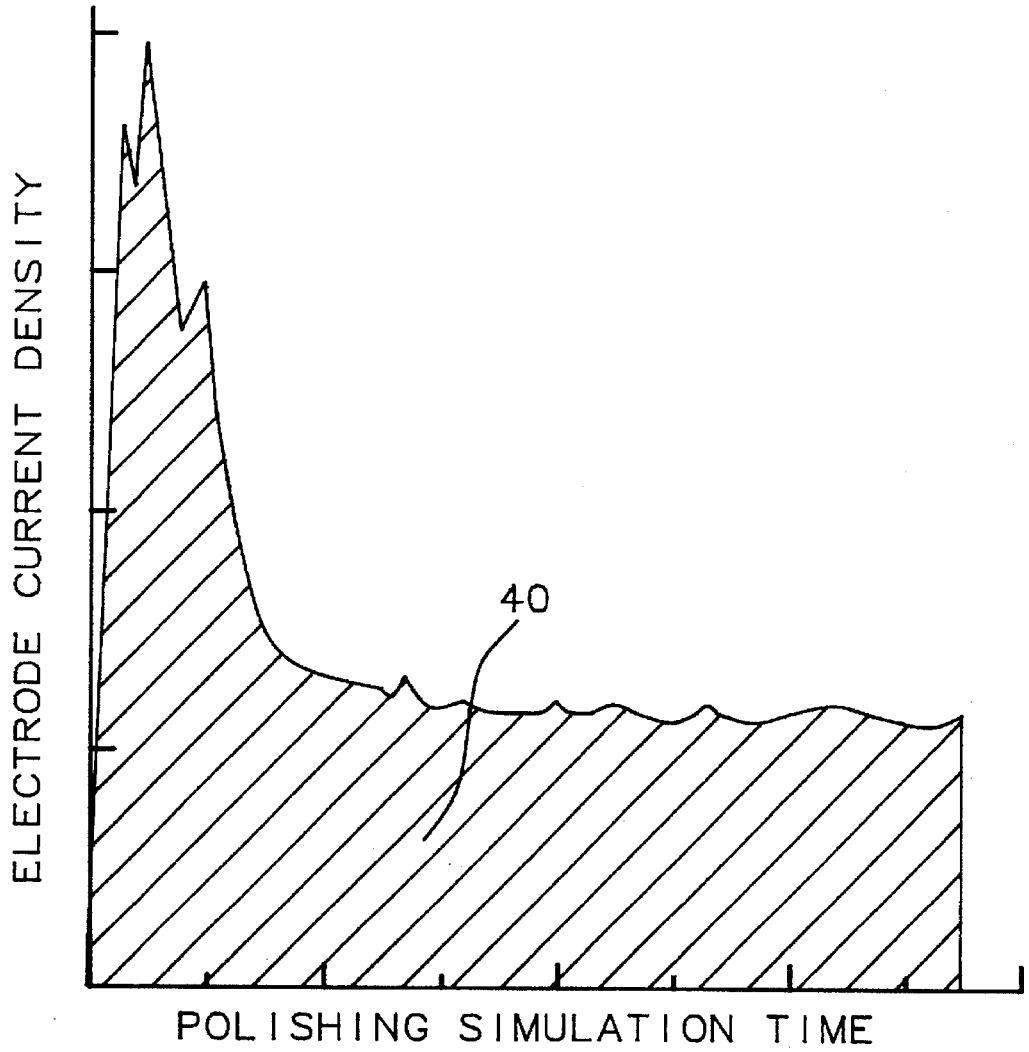
FIG. 3, which shows electrode current density versus polishing simulation time.

During application of the constant voltage by the potentiostat, 28, to each nickel electrode, 26A to 26E, the current density in each electrode is measured as a function of polishing simulation time and stored in computer memory, 29, through use of a conventional IEEE/488 interface, 30, and a conventional analog-to-digital (A/D) converter, 31. In this preferred embodiment the applied constant voltage is 1.5 volts; however, the applied constant voltage can be between about 1 to 5 volts. FIG. 3 shows electrode current density versus polishing simulation time for one of the electrodes embedded in the carrier, 22. In this example, the polishing slurry contains a ferrocyanide salt, such as potassium ferrocyanide, in solution with a conventional CMP slurry comprising abrasive particles, such as silica or alumina, and acidic or basic chemicals and $H_2O$ at a pH between about pH=2 to pH=12. Integration of the electrode current density with the polishing simulation time is a measure of the mass transfer rate of the slurry flow at the electrode. This area, designated as 40, under the current density curve is shown in FIG. 3. The result of the integration is generally called the "Sherwood Number". As stated the "Sherwood Number" represents the mass transfer rate of the slurry flow and is, therefore, an indication of the polish removal rate. An increase in "Sherwood Number" indicates that the polish removal rate has increased and a decrease in "Sherwood Number" indicates that the polish removal rate has decreased.

By systematically measuring the change in "Sherwood Number" as a function of a change in a CMP process parameter the predicted effect of the process change on the polish removal rate is obtained. Also, by measuring the "Sherwood Number" for each electrode in a plurality of electrodes in the carrier the uniformity of polish removal rate is predicted. When unacceptable non-uniformity of polish removal rate is predicted polishing process parameters can be adjusted to result in better polish uniformity.

Figure 4:
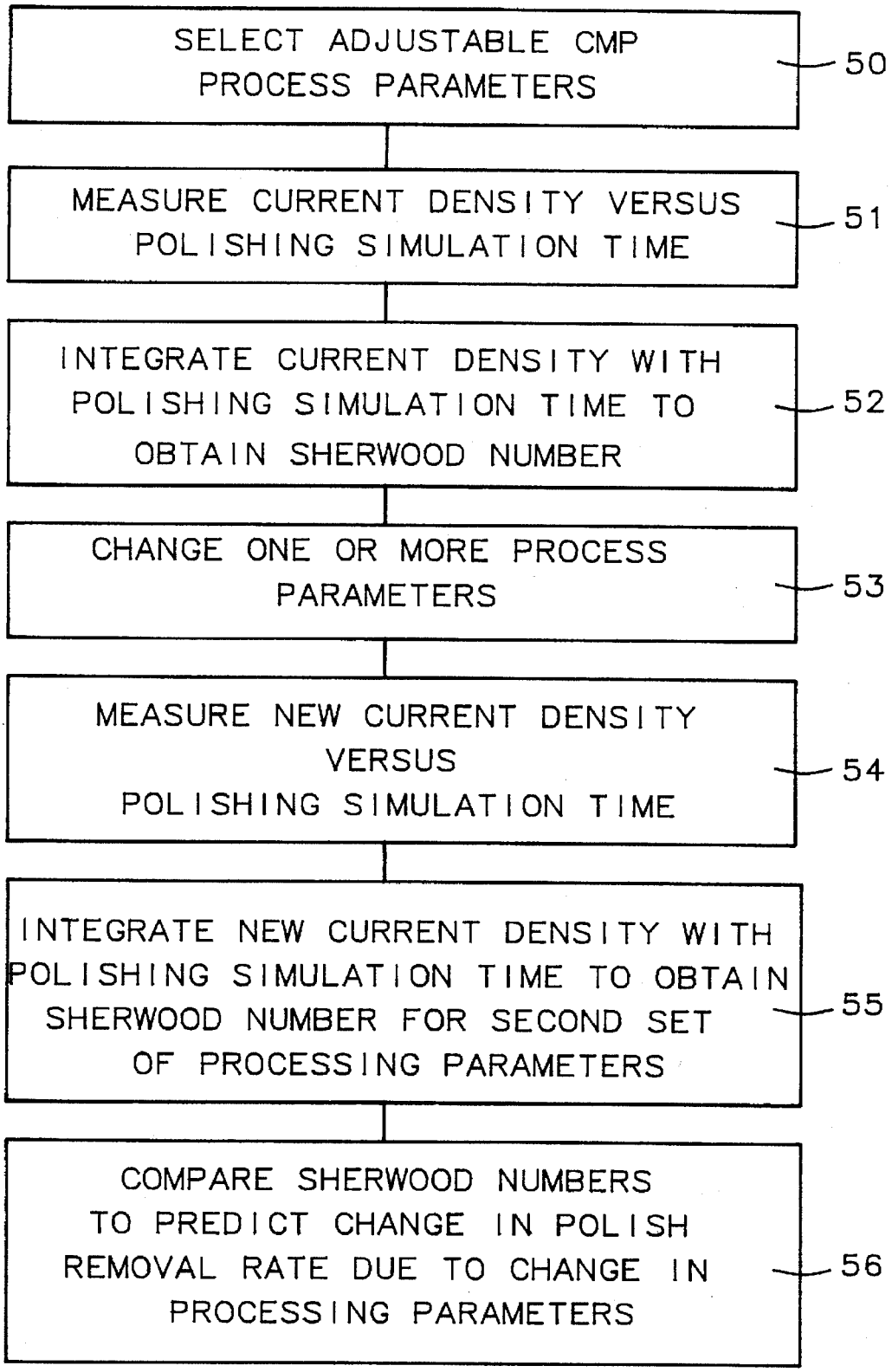
FIG. 4, which is a flow chart of the method of the present invention.

A flow chart for the basic steps of the method of the invention is shown in FIG. 4, illustrated for a single electrode embedded in the carrier. Step 50 selects the individually adjustable CMP process parameters. Step 51 measures the current density at the electrode versus the polishing simulation time for the selected CMP process parameters. Step 52 integrates the current density with the polishing simulation time to obtain the "Sherwood Number" for the selected processing parameters. Step 53 changes one or more process parameters. Step 54 measures a new current density versus polishing simulation time for the newly selected CMP process and Step 55 integrates the new current density with polishing simulation time to obtain the new "Sherwood Number" for the second set of processing parameters. By measuring the change in "Sherwood Number" which results from a change in CMP process parameters, Step 56, the predicted change in polish removal rate is obtained.

While the invention has been particularly shown and described with reference to the preferred embodiments thereof, it will be understood by those skilled in the art that various changes in form and details may be made without departing from the spirit and scope of the invention.

What is claimed is:

1. An apparatus for simulating chemical-mechanical polishing (CMP) of semiconductor substrates comprising:

a rotatable platen and polishing pad for chemical-mechanical polishing (CMP) a surface of a semiconductor wafer;

a reservoir for a polishing slurry and means to dispense the slurry onto the polishing pad;

a counter-electrode embedded in said rotatable platen;

a rotatable carrier holder and carrier having a plurality of electrodes embedded in the surface thereof;

a means for holding said rotatable carrier holder and carrier in juxtaposition relative to said rotatable platen and polishing pad with an applied pressure between the carrier and the polishing pad;

a means of applying a constant voltage between each electrode embedded in said rotatable carrier and said counter-electrode embedded in said rotatable platen;

a means of measuring the current density in each said embedded electrode during polishing simulation;

a means of storing in a computer memory data for current density versus polishing simulation time for each said electrode among the plurality of electrodes embedded in said rotatable carrier;

a means of integrating the measured current density with polishing simulation time for each said electrode among the plurality of electrodes embedded in said rotatable carrier; and a means of storing in a computer memory factors, generally called "Sherwood Numbers", which are the integrated current density with polishing simulation time for each said electrode among the plurality of electrodes embedded in said rotatable carrier.

2. The apparatus of claim 1, wherein said polishing slurry comprises silica or alumina and acidic or basic chemicals and $H_2O$ at a pH between about pH=2 to pH=12.

3. The apparatus of claim 1, wherein said rotatable platen and polishing pad are rotated at a speed between about 10 to 100 rpm.

4. The apparatus of claim 1, wherein said rotatable carrier holder and carrier are rotated at a speed between about 10 to 100 rpm.

5. The apparatus of claim 1, wherein said applied pressure between the carrier and the polishing pad is between about 1 to 10 psi.

6. The apparatus of claim 1, wherein said constant voltage applied between each electrode embedded in said rotatable carrier and said counter-electrode embedded in said rotatable platen is between about 1 to 10 volts.

7. The apparatus of claim 1, wherein the preferred constant voltage applied between each electrode embedded in said rotatable carrier and said counter-electrode embedded in said rotatable platen is between about 1 to 5 volts.

8. The apparatus of claim 1, having between about 1 to 10 electrodes embedded in said rotatable carrier.

9. The apparatus of claim 1, having at least one electrode embedded in said rotatable carrier.

10. A method for simulating chemical-mechanical polishing (CMP) of semiconductor substrates comprising:

providing a rotatable platen and polishing pad, having a counter-electrode embedded therein;

providing a rotatable carrier holder and carrier having a plurality of electrodes embedded in the surface thereof;

providing a means for holding said rotatable carrier holder and carrier in juxtaposition relative to said rotatable platen and polishing pad with an applied pressure between the carrier and the polishing pad;

providing a means for dispensing a polishing slurry onto said rotating polishing pad;

applying a constant voltage between each electrode embedded in said rotatable carrier and said counterelectrode embedded in said rotatable platen;

measuring the current density in each said embedded electrode during polishing simulation;

storing in a computer memory data for current density versus polishing simulation time for each said electrode among the plurality of electrodes embedded in said rotatable carrier;

integrating the measured current density with polishing simulation time for each said electrode among the plurality of electrodes embedded in said rotatable carrier; and storing in a computer memory factors, generally called "Sherwood Numbers", which are the integrated current density with polishing simulation time for each said electrode among the plurality of electrodes embedded in said rotatable carrier.

11. The method of claim 10, wherein said polishing slurry comprises silica or alumina and acidic or basic chemicals and $H_2O$ at a pH between about pH=2 to pH=12.

12. The method of claim 10, wherein said rotatable platen and polishing pad are rotated at a speed between about 10 to 100 rpm.

13. The method of claim 10, wherein said rotatable carrier holder and carrier are rotated at a speed between about 10 to 100 rpm.

14. The method of claim 10, wherein said applied pressure between the carrier and the polishing pad is between about 1 to 10 psi.

15. The method of claim 10, wherein said constant voltage applied between each electrode embedded in said rotatable carrier and said counter-electrode embedded in said rotatable platen is between about 1 to 10 volts.

16. The method of claim 10, wherein the number of electrodes embedded in said carrier is between about 1 and 10.

17. The method of claim 10, wherein at least one electrode is embedded in said carrier.

18. The method of claim 10, wherein said "Sherwood Numbers" are proportional to the mass transfer rates, thereby simulating the polish removal rates.

19. A method for simulating chemical-mechanical polishing (CMP) of semiconductor substrates comprising:

providing a rotatable platen and polishing pad, having a counter-electrode embedded therein;

providing a a rotatable carrier holder and carrier having a plurality of electrodes embedded in the surface thereof;

providing a means for holding said rotatable carrier holder and carrier in juxtaposition relative to said rotatable platen and polishing pad with an applied pressure between the carrier and the polishing pad;

providing a means for dispensing a polishing slurry containing a ferrocyanide salt onto said rotating polishing pad;

applying a constant voltage between each electrode embedded in said rotatable carrier and said counter-electrode embedded in said rotatable platen;

measuring the current density in each said embedded electrode during polishing simulation;

storing in a computer memory data for current density versus polishing simulation time for each said electrode among the plurality of electrodes embedded in said rotatable carrier;

integrating the measured current density with polishing simulation time for each said electrode among the plurality of electrodes embedded in said rotatable carrier; and storing in a computer memory factors, generally called "Sherwood Numbers", which are the integrated current density with polishing simulation time for each said electrode among the plurality of electrodes embedded in said rotatable carrier.

20. The method of claim 19, wherein said polishing slurry containing a ferrocyanide salt further comprises silica or alumina and acidic or basic chemicals and $H_2O$ at a pH between about pH=2 to pH=12.

21. The method of claim 20, wherein said ferrocyanide salt is potassium ferrocyanide at a concentration between about 0.01 to 0.1 Molar.

22. The method of claim 19, wherein said rotatable platen and polishing pad are rotated at a speed between about 10 to 100 rpm.

23. The method of claim 19, wherein said rotatable carrier holder and carrier are rotated at a speed between about 10 to 100 rpm.

24. The method of claim 19, wherein said applied pressure between the carrier and the polishing pad is between about 1 to 10 psi.

25. The method of claim 19, wherein said constant voltage applied between each electrode embedded in said rotatable carrier and said counter-electrode embedded in said rotatable platen is between about 1 to 10 volts.

26. The method of claim 19, wherein at least one electrode is embedded in said carrier.

27. The method of claim 19, wherein said "Sherwood Numbers" are proportional to the mass transfer rates, thereby simulating the polish removal rates.

* * * * *